United States Patent [19]

Abriany

[11] 3,960,509

[45] June 1, 1976

[54] CATALYTIC MUFFLER

[76] Inventor: Raymond R. Abriany, 3840 Valley Brink, Los Angeles, Calif. 90039

[22] Filed: Dec. 30, 1974

[21] Appl. No.: 537,520

[52] U.S. Cl. ..... 23/288 F; 23/288 F; 181/36 C; 181/55; 181/59; 55/276; 55/512; 55/DIG. 30

[51] Int. Cl.[2] ..... F01N 3/15

[58] Field of Search ..... 23/288 F, 288 R; 181/36 C, 42, 50, 71, 55, 59; 55/512, 515, 516, 518, DIG. 30, 276

[56] References Cited

UNITED STATES PATENTS

| | | | |
|---|---|---|---|
| 2,315,208 | 3/1943 | Kinnard | 23/288 RD |
| 3,186,807 | 6/1965 | Bolek | 23/288 F |
| 3,712,030 | 1/1973 | Priest | 23/284 X |

*Primary Examiner*—James N. Tayman, Jr.
*Assistant Examiner*—James H. Tayman, Jr.
*Attorney, Agent, or Firm*—Sughrue, Rothwell, Mion, Zinn & Macpeak

[57] ABSTRACT

A catalytic muffler is described with reference to three preferred embodiments. In the first embodiment, a cylindrical entry tube having peripheral holes passes into the interior of the muffler, a second cylindrical tube having peripheral holes offset from the peripheral holes in the entry tube surrounds the entry tube, a cartridge containing a catalytic converter surrounds the second tube, and an exit tube leads from a point in the interior of the muffler external to the cartridge to the exterior of the muffler. In the second embodiment, the entry tube is branched within the muffler, and each branch is surrounded by a cartridge containing a catalytic converter. In the third embodiment, the entry tube, the second tube, and the cartridge all have cross-sections in the shapes of racetracks the major and minor axes of which are coincident. In all three embodiments, the cartridge is filled with asbestos fibers impregnated first with sodium and then with copper sulfate.

9 Claims, 9 Drawing Figures

CATALYTIC MUFFLER

FIELD OF THE INVENTION

My invention pertains to catalytic mufflers.

SUMMARY OF THE INVENTION

My invention comprises an improved muffler containing an improved cartridge for a catalytic converter. The invention is described with reference to three preferred embodiments of the muffler. In the first embodiment, a cylindrical entry tube having peripheral holes passes into the interior of the muffler, a second cylindrical tube having peripheral holes offset from the peripheral holes in the entry tube surrounds the entry tube, a cartridge containing a catalytic converter surrounds the second tube, and an exit tube leads from a point in the interior of the muffler external to the cartridge to the exterior of the muffler. In the second embodiment, the entry tube is branched within the muffler, and each branch is surrounded by a cartridge containing a catalytic converter. In the third embodiment, the entry tube, the second tube, and the cartridge all have cross-sections in the shapes of racetracks the major and minor axes of which are coincident. In all three embodiments, the cartridge is filled with asbestos fibers impregnated first with sodium and then with copper sulfate. In all three embodiments, the interior of the cartridge is divided into at least three longitudinal compartments by transverse partitions.

DETAILED DESCRIPTIONS OF THE PRESENTLY PREFERRED EMBODIMENTS

Figure 4:
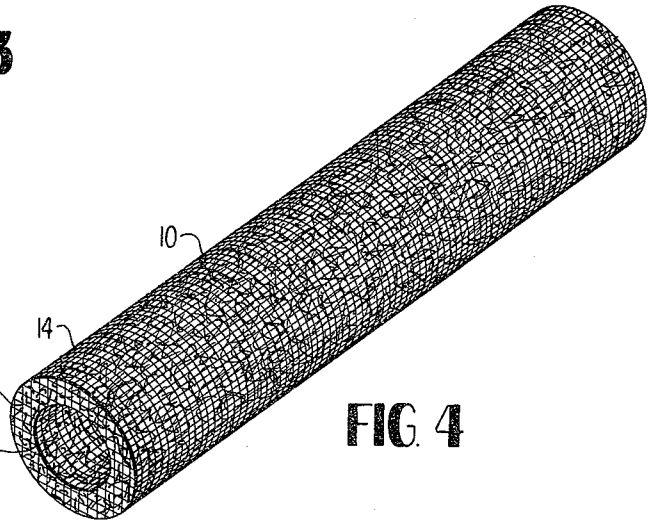
FIG. 4 is a perspective view of the cartridge used in the muffler shown in FIG. 1.
Figure 3:
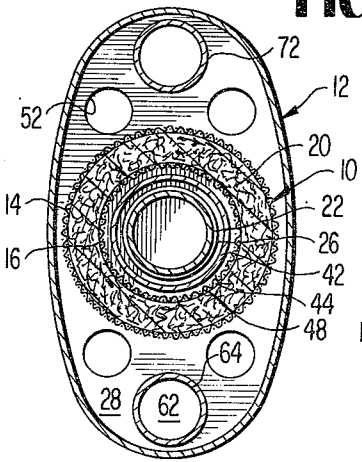
FIG. 3 is a sectional view along the line 3—3 in FIG. 2.
Figure 1:
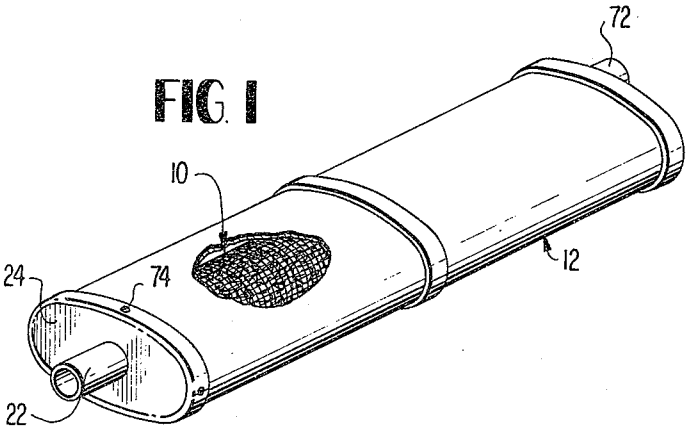
FIG. 1 is a perspective view of a first embodiment of the improved muffler according to my invention, with part of the exterior broken away to show the cartridge.
Figure 2:
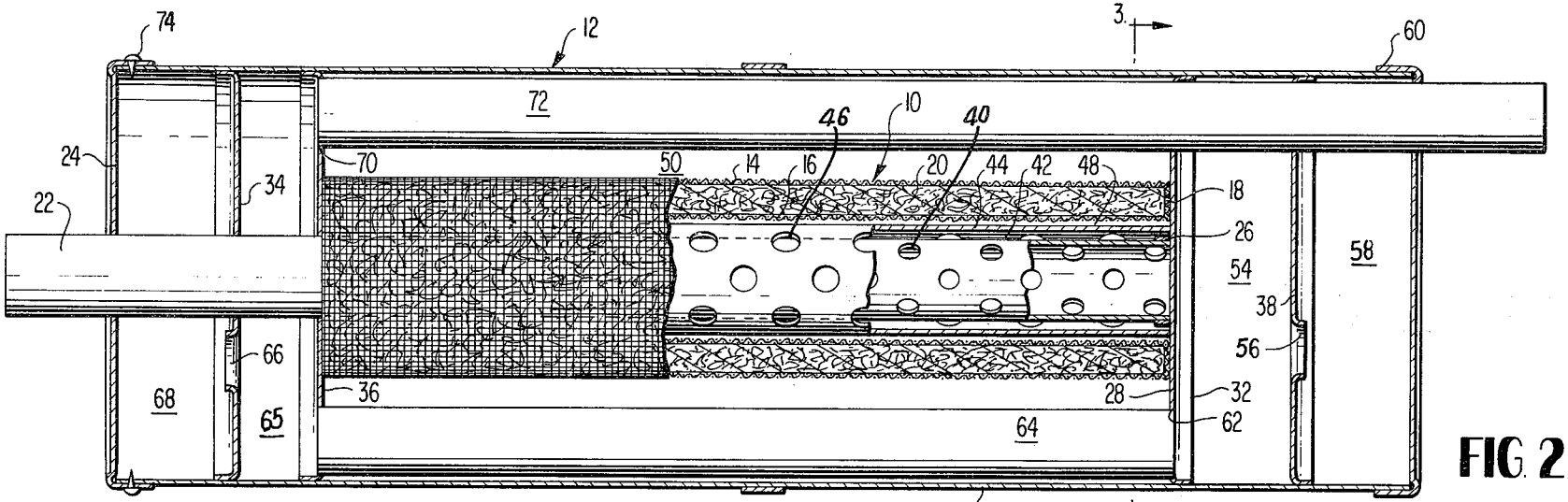
FIG. 2 is a horizontal sectional view of the muffler shown in FIG. 1.

Three embodiments of my invention are described hereinafter. The differences among the various embodiments are simply questions of construction, the basic theory of each being the same.

The First Embodiment

The first embodiment of my invention is shown in FIGS. 1—4. It comprises, broadly speaking, a cartridge 10 which is replaceable at relatively frequent intervals (e.g., every 6,000 miles) and a muffler body 12 which, though replaceable in the manner of all mufflers, is intended to last through many replacements of the cartridge 10.

The cartridge 10 is composed of two mesh cylinders 14 and 16, both of which are made of copper. The two cylinders 14 and 16 are joined at their extremities by ring-shaped discs 18 of steel mesh soldered to the cylinders 14 and 16. The interior volume defined by the two cylinders 14 and 16 and the two discs 18 is filled with specially prepared asbestos fibers 20.

The asbestos fibers 20 are prepared as follows. First, raw fibers are carded, then they are impregnated with sodium by immersion in a bath of a sodium-containing, water-soluble compound, such as sodium chloride dissolved in water. Then, after the fibers have completely dried, they are impregnated with copper sulfate by immersion in a bath of copper sulfate dissolved in water. Finally, after the fibers have again been completely dried, they are packed between the two cylinders 14 and 16 sufficiently tightly to leave no void, but loosely enough to allow the passage of combustion gases.

The muffler body 12 provides a circuitous path for the combustion gases and ensures that the combustion gases pass through the asbestos fibers before they are emitted into the atmosphere. The combustion gases enter the muffler body 12 via a tube 22 which passes through a gas-tight aperture in the removable muffler cap 24 and is held in place interiorly of the muffler body 12 by an annular collar 26 projecting longitudinally from a transverse partition 28 attached to the inside of the muffler wall 30 by means of a flange 32. Three other transverse partitions 34, 36, and 38 are similarly mounted interiorly of the muffler body to further circuitize the passage of the combustion gases through the muffler body 12.

The partition 28 is solid where the tube 22 butts against it, but a plurality of holes 40 are provided in the tube 22 to permit the combustion gases to pass from within the tube 22 to an annular volume 42 between the tube 22 and a second tube 44 which coaxially surrounds the tube 22. The annular volume 42 also butts against a solid portion of the partition 28, but a plurality of holes 46 are provided in the tube 44 to permit the combustion gases to pass from within the tube 44 to an annular volume 48 between the tube 44 and the interior cylinder 16 of the cartridge 10. It should be noted here that the holes 46 are somewhat larger than the holes 40 and that they are offset with resect to the holes 40 so that the combustion gases are required to follow circuitous paths within the annular volume 42 as they pass from the holes 40 to the holes 46. It should also be noted that, since the cartridge 10 is loosely mounted over the tube 44 and between the partitions 28 and 36, the "annular volume 48" may not be strictly annular, but may be of lesser width (or even of no width) on the top side of the muffler than it is on the bottom. This asymmetry, however, is a matter of no consequence.

The combustion gases which pass through the tube 22, the annular volume 42, the tube 44, the annular volume 48, the interior cylinder 16, the asbestos fibers 20, and the exterior cylinder 14 then enter a first inner volume 50 defined by the exterior cylinder 14, the muffler wall 30, and the two partitions 28 and 36. However, a plurality of holes 52 are provided in the partition 28 between the exterior cylinder 14 and the muffler wall 30, and the combustion gases pass from the inner volume 50 into a second inner volume 54 defined by the muffler wall 30 and the partitions 28 and 38. From there, the combustion gases can follow either of two possible routes. The first possible route is through a hole 56 in the partition 38 into a third inner volume 58 defined by the muffler wall 30, the partition 38, and a muffler cap 60 permanently mounted on the down stream end of the muffler wall 30. Since there is only the single exit from the volume 58 provided by the hole 56, the combustion gases which find their way into the volume 58 eventually find their way back through the hole 56 and into the volume 54. The second possible route is through a hole 62 in the partition 28 and into a tube 64 which is held between the partition 28 and the partition 36. The tube 64 carries the combustion gases through the inner volume 50 without mixing with the combustion gases contained therein and into a fourth inner volume 65 defined by the muffler wall 30 and the partitions 34 and 36. Like the volume 54, the volume 65 has two exits. First, combustion gases in the volume 65 can pass through a hole 66 in the partition 34 into a fifth inner volume 68 defined by the muffler wall 30, the partition 34, and the removable muffler cap 24. Since there is also only the single exit from the volume 68 provided by the hole 66, the combustion gases which find their way into the volume 68 eventually find their way back through the hole 66 and into the volume 65. Second, combustion gases in the volume 65 can pass through a hole 70 in the partition 36 and into a tube 72 which is held between the partition 36 and the permanently mounted muffler cap 60. The tube 72 carries the combustion gases through the inner volumes 50, 54, and 58 without mixing with the combustion gases contained therein and out to the exterior of the muffler body 12.

Figure 5:
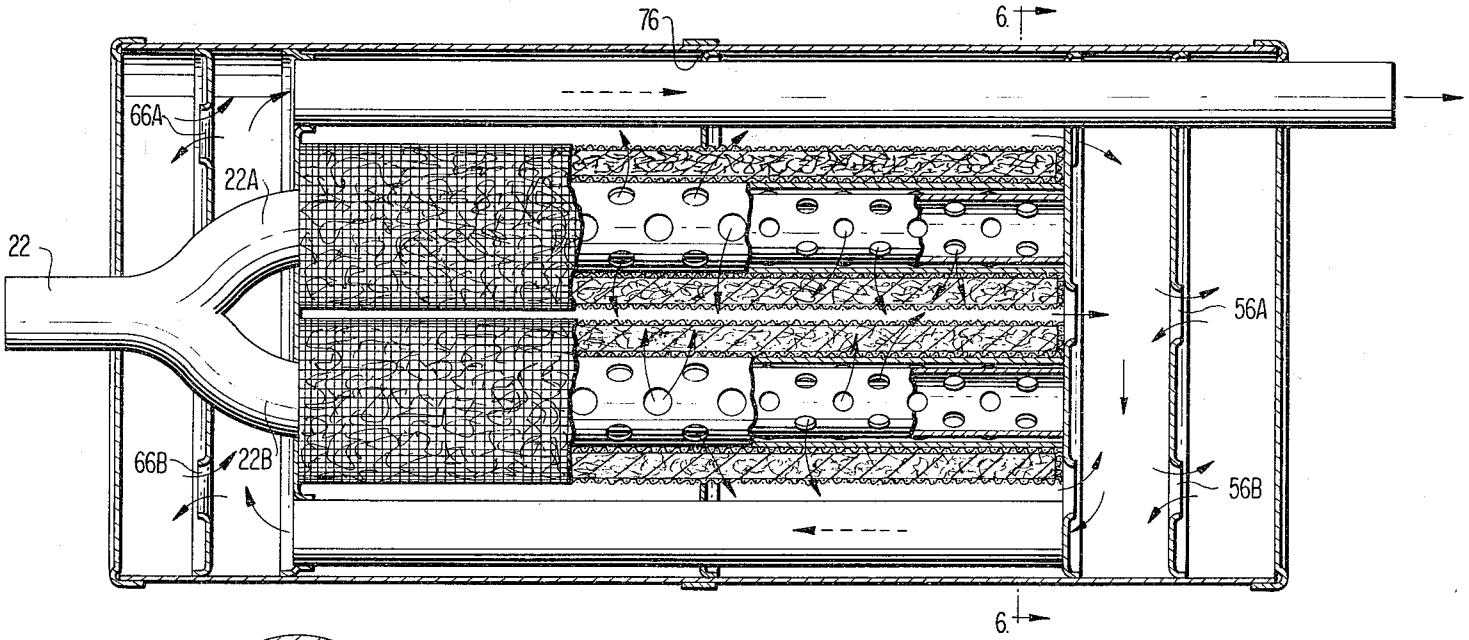
FIG. 5 is a horizontal sectional view of a second embodiment of the improved muffler according to my invention.

The muffler cap 24 is removable attached to the muffler wall 30 by attachment means 74. When it is desired to change the cartridge 10, as for instance at the time when routine maintenance is normally performed on the car, the muffler cap 24 is first removed from the muffler wall 30 and from the tube 22, the partitions 34 and 36 are then removed from the interior of the muffler wall 30 (the tubes 64 and 72 may optionally be integral with the partition 36, as shown in FIG. 5 for the second embodiment, and, if they are, they of course will also come out at this stage), and finally the cartridge 10 is slid axially off the tube 44. A new cartridge 10 is then substituted for the old one, and the muffler body 12 is reassembled.

The Second Embodiment

Figure 6:
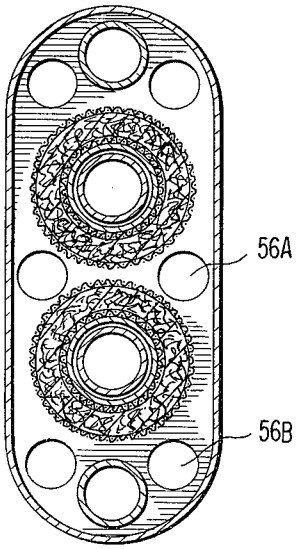
FIG. 6 is a sectional view along the line 6—6 in FIG. 5.

The second embodiment of my invention is shown in FIGS. 5 and 6. It varies from the first embodiment only in that the tube 22 branches into two separate tubes 22A and 22B. Each of tubes 22A and 22B is then surrounded with a cartridge 10 identical in construction to the cartridge 10 used in the first embodiment. The somewhat more complex paths of the combustion gases in this embodiment are indicated by arrows on the drawings. An additional partition 76 has been provided for structural support, and pairs of holes 56A and 56B and 66A and 66B have been provided in the partitions 38 and 34, respectively, but otherwise the construction is essentially the same as that of the first embodiment and will not be described further.

The Third Embodiment

Figure 7:
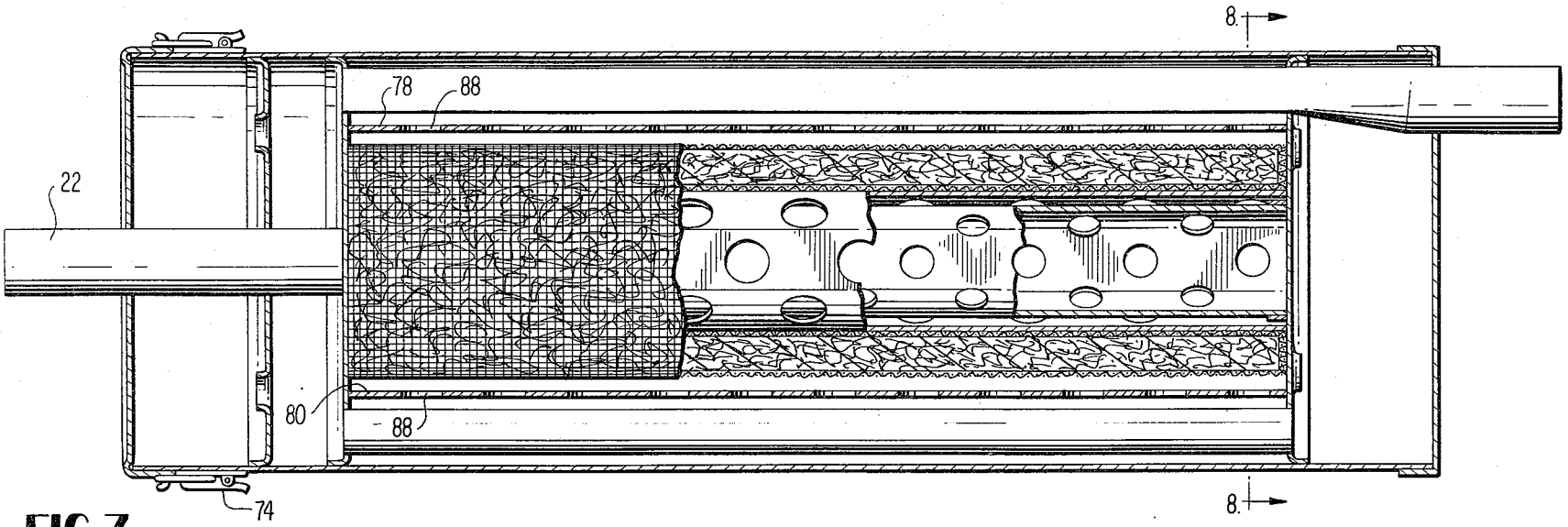
FIG. 7 is a horizontal sectional view of a third embodiment of the improved muffler according to my invention.
Figure 9:
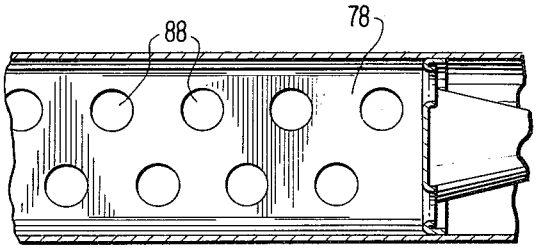
FIG. 9 is a fragmentary sectional view along the line 9—9 in FIG. 8.
Figure 8:
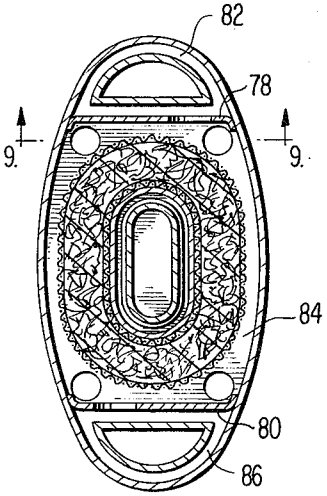
FIG. 8 is a sectional view along the line 8—8 in FIG. 7.

The third embodiment of my invention is shown in FIGS. 7–9. If differs from the first embodiment primarily in shape. The tube 22 is flattened into racetrack shape in order to increase the thickness of the layer of asbestos and to increase the efficiency of the device. Additionally, longitudinal partitions 78 and 80 are provided to break the inner volume 50 of the first embodiment into three separate inner volumes 82, 84, and 86 which communicate with each other by means of the holes 88 in the longitudinal partitions 78 and 80. Otherwise, the construction of this embodiment is essentially the same as that of the first two embodiments, and it will not be described further.

CAVEAT

While the present invention has been illustrated by detailed descriptions of three preferred embodiments thereof, it will be obvious to those skilled in the art that various changes in form and detail can be made therein without departing from the true scope of the invention. For that reason, the invention must be measured by the claims appended hereto and not by the foregoing preferred embodiments.

What is claimed is:

1. A catalytic muffler comprising:

a. muffler walls defining an inner volume which is gas-tight except for entry and exit tubes recited hereinafter;

b. an entry tube which passes from the outside of the muffler walls into the inner volume defined by said muffler walls, said entry tube having a plurality of holes in the longitudinal wall thereof in the portion of said entry tube within the inner volume defined by said muffler walls;

c. a second tube at least a portion of which surrounds at least a portion of the portion of said entry tube within the inner volume defined by said muffler walls, said second tube likewise having a plurality of holes in the longitudinal wall thereof in the portion of said second tube surrounding said entry tube, the holes in said second tube being adjacent to but offset from the holes in said entry tube, whereby the combustion gasses passing through the muffler are required to follow circuitous paths in a first volume between said entry tube and said second tube;

d. a cartridge containing a catalytic converter surrounding at least the portion of said second tube which has holes in the longitudinal wall thereof; and e. an exit tube which passes from the outside of the muffler walls into the inner volume defined by said muffler walls and which opens into that inner volume at a point on the side of said cartridge remote from said second tube;

said entry tube, said second tube, and said cartridge all extend into the muffler at least approximately the same distance, and f. a first partition i. extending transversely of the muffler at the inner ends of said entry tube, said second tube; and said cartridge, ii. butting against the inner ends of said entry tube, said second tube, and said cartridge, and iii. having at least three holes therethrough radially outside said cartridge;

g. a second partition i. extending transversely of the muffler between said first partition and the point where said entry tube passes through said muffler walls, ii. engaging the inside of said muffler walls, the outside of said entry tube, and the outer end of said second tube, and iii. having at least two holes therethrough radially outside said cartridge; and h. a third tube which extends from a hole in said first partition to a hole in said second partition, and wherein said exit tube extends from a hole in said second partition, through a hole in said first partition, and through said muffler walls at a point on the side of said first partition remote from said second partition, whereby the combustion gasses passing through the muffler pass through the holes in said entry tube into the first volume, then through said second tube and said cartridge into a second volume defined by said muffler walls, the outer surface of said cartridge, and said first and second partition, then through one or more holes in said first partion into a third volume defined at least in part by said muffler walls and said first partition, then through said third tube into a fourth volume defined at least in part by said muffler walls and said second partition, and then through said exit tube to the outside of the muffler.

2. A catalytic muffler as recited in claim 1 wherein said cartridge comprises:

a. cartridge walls defining an inner volume, at least one of said cartridge walls being permeable to combustion gases and being adapted to surround said second tube so that combustion gases will pass through said at least one of said cartridge walls into the inner volume defined by said cartridge walls and at least another of said cartridge walls also being permeable to combustion gases and being adapted to permit egress of combustion gases which have passed through said at least one of said cartridge walls and through the inner volume defined by said cartridge walls and b. asbestos fibers impregnated first with sodium and then with copper sulfate and packed into the inner volume defined by said cartridge walls sufficiently tightly to leave no void, but loosely enough to allow the passage of combustion gases.

3. A catalytic muffler as recited in claim 2 wherein said entry tube, said second tube, and said cartridge are all cylindrical and are at least approximately coaxial.

4. A catalytic muffler as recited in claim 2 wherein said entry tube branches into two tubes, each surrounded longitudinally by a cartridge containing a catalytic converter, within the inner volume defined by said muffler walls.

5. A catalytic muffler as recited in claim 2 wherein said entry tube, said second tube, and said cartridge all have cross-sections in the shape of racetracks the major and minor axes of which are coincident.

6. A catalytic muffler as recited in claim 1 wherein said entry tube, said second tube, and said cartridge are all cylindrical and are at least approximately coaxial.

7. A catalytic muffler as recited in claim 1 wherein said entry tube branches into two tubes, each surrounded longitudinally by a cartridge containing a catalytic converter, within the inner volume defined by said muffler walls.

8. A catalytic muffler as recited in claim 1 wherein said entry tube, said second tube, and said cartridge all have cross-sections in the shape of racetracks the major and minor axes of which are coincident.

9. A catalytic muffler as recited in claim 1 and further compising:

a. a third partition i. extending transversely of the muffler between said first partition and said muffler walls and ii. having at least two holes therethrough and b. a fourth partition i. extending transversely of the muffler between said second partition and said muffler walls and ii. having at least two holes therethrough and wherein i. said exit tube passes through a hole in said third partion and ii. said entry tube passes through a hole in said fourth partion, whereby at least some of the combustion gasses passing through the muffler pass from the second volume into a fifth volume defined by said muffler walls, said third partition, and the outer wall of said exit tube and at least some of the combustion gasses pass from the fourth volume into a sixth volume defined by said muffler walls, said fourth partition, and the outer wall of said entry tube.

* * * * *